United States Patent [19]

Currier

[11] 4,066,443

[45] Jan. 3, 1978

[54] PROCESS OF STABILIZING THE OPERATION OF BLAST FURNACES FOR PRODUCING MOLTEN IRON

[75] Inventor: James W. Currier, Palatine, Ill.

[73] Assignee: International Minerals and Chemical Corporation, Libertyville, Ill.

[21] Appl. No.: 618,144

[22] Filed: Sept. 30, 1975

[51] Int. Cl.[2] ..... C21B 5/00

[52] U.S. Cl. ..... 75/41; 75/30; 75/257

[58] Field of Search ..... 75/41, 42, 30, 94

[56] References Cited

U.S. PATENT DOCUMENTS 3,966,456 6/1976 Ellenbaum ..... 75/30

*Primary Examiner*—M. J. Andrews

*Attorney, Agent, or Firm*—Leydig, Voit, Osann, Mayer & Holt, Ltd.

[57] ABSTRACT

A process of producing molten iron in a blast furnace in which the alkali loading to the blast furnace is at least about four pounds of alkali oxides per ton of hot metal produced, in which the alkali metal content in the furnace slag fluctuates widely due to repetitive accumulation and purging of alkali metals in the furnace over extended operating periods with corresponding fluctuations in the sulfur content and temperature of the molten metal, and in which the MgO content in the furnace slag is in the range of about 6 to about 18% by weight. Olivine is added to the furnace charge, preferably on a substantially continuous basis at an average rate of about 10 to about 100 pounds of olivine per ton of molten iron produced in the furnace, to effect the removal of the alkali metals from the furnace in the furnace slag and thereby stabilize the furnace operation. The olivine addition is particularly useful when the maximum alkali oxide content in the furnace slag fluctuates frequently by at least about 100% above the average alkali metal oxide content of the slag, in the absence of the olivine addition. The olivine is charged to the furnace ahead of the iron ore in the charge. The olivine addition may also be used to remove the alkali metals from the blast furnace when the cyanide content in the scrubber water fluctuates widely due to repetitive accumulation and purging of alkali metals in the furnace over extended operating periods. This process reduces the consumption of coke and other fuels in the blast furnace, increases production rates and the percentage of on-specification metal produced by the furnace, virtually eliminates furnace upsets due to alkali build-ups and improves overall furnace operation.

8 Claims, 20 Drawing Figures

COMPARATIVE DISTRIBUTION OF SULFUR IN METAL CASTS

CUMULATIVE DISTRIBUTIONS OF SULFUR IN METAL CASTS

COMPARATIVE DISTRIBUTION OF POTASSIUM ($K_2O$) IN THE CAST SLAGS

COMPARATIVE DISTRIBUTION OF SODIUM ($NA_2O$) IN THE CAST SLAGS

SODIUM ($Na_2O$) VS POTASSIUM ($K_2O$) CONTENTS OF SLAGS

14 WEEK BASE PERIOD

SODIUM ($Na_2O$) VS POTASSIUM ($K_2O$) CONTENTS OF SLAGS

5 WEEK OLIFLUX TEST PERIOD

PROCESS OF STABILIZING THE OPERATION OF BLAST FURNACES FOR PRODUCING MOLTEN IRON

DESCRIPTION OF THE INVENTION

The present invention relates generally to blast furnaces and, more particularly, to an improved process for stabilizing the operation of blast furnaces for producing molten iron.

Alkali metals are becoming an increasing problem in steel mill blast furnaces as the mills are forced to use lower grades of iron ore and/or coke, either for economic reasons or because of the unavailability of the higher grade materials. Although it is naturally desirable to use the highest grades of charge materials available in blast furnace practice, some of the very high grade materials are no longer available and the general trends are toward lower grades of ore and coke. While the iron content of the charge components may not have dropped appreciably, the current trends are toward ores that contain more of the undesirable components such as the alkali metal components. Similarly in the area of coking coals, the high grade coals have been largely depleted, and there is a trend toward weaker cokes often containing increased levels of alkali.

The alkali problem thus becomes twofold. Higher loadings of alkalis have to be charged to the furnaces, and weaker cokes which are more susceptible to alkali attack have to be used. Since the alkali loading and coke strengths are critical parameters in the operation of a blast furnace, the net trend is toward generally inferior furnace performances. Under certain conditions, the alkali metals tend to accumulate within the blast furnace, and then at sporadic intervals the furnace purges itself of the alkali metals. This leads to furnace upsets and causes repetitive wide fluctuations in the furnace operation and in the quality of the resulting metal.

Most of the alkali metals fed to a blast furnace tend to report to the slag. Under any given set of operating conditions, the amounts of alkali metals that can be accommodated in the slag are limited. When the alkali metal input levels exceed the slag's capacity, the alkalis tend to accumulate in the furnace via a volatilization process. The levels at which incipient performance problems occur due to alkali metals depend on the specific operating conditions of a furnace. As the alkali loadings exceed certain limits, the severity of the performance problems tend to increase. From a practical standpoint, sodium and potassium are the primary alkalis normally encountered. Of these, potassium seems to be more objectionable because its compounds tend to be more volatile than the comparable sodium compounds.

The vaporization and accumulation of alkali compounds within a blast furnace lead to a number of undesirable conditions. Recycling of alkalis within the furnace can lead to substantial build-ups in the furnace's retained alkali content. One of the results of this sort of alkali accumulation within a furnace is the formation of stationary structures (scabs and bridges) within the cooler portions of the burden column. Such structures limit both the upward passage of the wind and the downward movement of the burden, and the net result is a curtailment in the production rate. When these stationary structures break loose, precipitous burden movements can occur. Furthermore, as these relatively cool structures peel and pass into the hearth, the cast temperatures drop uncontrollably, and the cast chemistries are adversely affected. It has also been established that alkali accumulations can be responsible for major increases in the swelling of pelletized ores which, in turn, can aggravate scab and bridge formation.

Because free alkali metals can be produced in a blast furnace by the carbothermic reduction of the volatilized compounds, free alkali metals are available to attack the graphitic structure of coke. The free alkali metals form intercalcation compounds with the graphitic structure of coke, which reduces the coke's ability to support the burden column. It also leads to frequent coke messes in which substantial quantities of degraded coke are lost through the tap hole.

It can be hypothesized that the accumulation of alkalis in a blast furnace can lead to cyanide fixation in a furnace and appreciable carryover of cyanides into the top gas scrubber waters. This hypothesis is supported by the fact that it has been observed that molten alkali cyanides sometimes exude from the bosh area of a furnace. Cyanide radicals formed in the high temperature zone of the furnace could be fixed by free alkali metals which are formed by the carbothermic reduction of volatile alkali compounds as explained before. Condensation of the simple cyanide salts on dust particles being blown through the furnace could be responsible for part of the free cyanides finally caught in the gas scrubber, and the reaction of free alkali metal cyanides with the iron-bearing components in a blast furnace could likewise account for ferrocyanides being carried over and trapped in the same scrubber system.

The performance of a blast furnace is affected by an alkali problem in many ways. Irregular burden movement can occur ranging from hanging conditions (the failure of burden to move to all) to massive slips (precipitous burden movement) which can cause severe damage or even cause a furnace to go out completely. A substantial restriction of wind passage through the furnace is also common in conjunction with an alkali problem. All of this substantially reduces the production capability of a furnace.

Moreover, the alternate purging and accumulation of alkalis accompanied by the peeling and formation of scabs leads to uncontrolled cast temperature variations. These variations, in turn, lead to uncontrolled cast chemistries and the production of off-specification metal.

The alkali loading at which incipent alkali problems occur depends on the specific operating conditions for the blast furnace. In general, large furnaces seem to experience greater sensitivity to the problem. Likewise, poor quality coke or burden materials can sensitize a furnace to an alkali problem.

As the slag becomes more acidic, larger loadings of alkali can be tolerated since the slag's capacity to carry alkalis is enhanced. Certain restraints have to be exercised in this regard, however, because a certain slag basicity is needed to achieve appropriate metal desulfurization. Similarly it should be noted that a slag's total capacity to remove alkalis can be enhanced simply by increasing the slag volume. Beyond a certain point, however this practice requires too much fuel to be practical. At higher operating temperatures, the alkali loading at which incipient problems will occur is reduced because the vapor pressures of the alkali components increase with increasing temperatures. On the other hand, elevated temperatures are often required in order to achieve appropriate metal chemistries.

The degrees of freedom available to deal with an alkali problem in a blast furnace are, therefore, often highly restricted. Operating conditions must be balanced to achieve appropriate production and quality of metal while, at the same time, they must deal realistically with the need to handle an alkali in the loading.

It is a primary object of the present invention to provide a process of stabilizing the operation of a blast furnace to avoid excessive accumulation of alkalis in the furnace and to avoid wide fluctuations of the alkali metal content in the furnace slag due to repetitive accumulation and purging of alkali metals in the furnace over extended operating periods. A related object of the invention is to provide such a process that avoids wide fluctuations in the quality and temperature of the molten metal produced in the furnace.

Another important object of the invention is to provide a process of stabilizing the operation of a blast furnace to avoid wide fluctuations of the cyanide content in the scrubber water due to repetitive accumulation and purging of alkali metals in the furnace over extended operating periods. A related object of the invention is to provide such a process that facilitates continuous removal or conversion of the cyanides in the waste water from the scrubber so that such water is an acceptable waste discharge.

A further object of the invention is to provide a process of the foregoing type that reduces the consumption of coke and other fuels in the blast furnace.

Yet another object of the invention is to provide such a process that increases production rates by avoiding periods of slack wind operation which reduce production and by increasing the percentage of on-specification metal produced by the flast furnace.

A still further object of the invention is to provide such a process that virtually eliminates blast furnace upsets due to alkali build-ups. Thus, more specific objects of the invention are to eliminate metallurgical upsets due to slag chemistry or temperature variations, to improve coke stability in the furnace, and to reduce operational upsets such as wind blockage, tuyere breakage, furnace hangs and slips.

It is still another object of the invention to provide such an improved process which improves furnace operation by providing more uniform burden movement in the furnace, enabling the furnace to be operated at maximum blast pressures, and reducing the production of flue dust.

Other objects and advantages of the invention will be apparent from the following detailed description and the accompanying drawings, in which.

Figure 1:
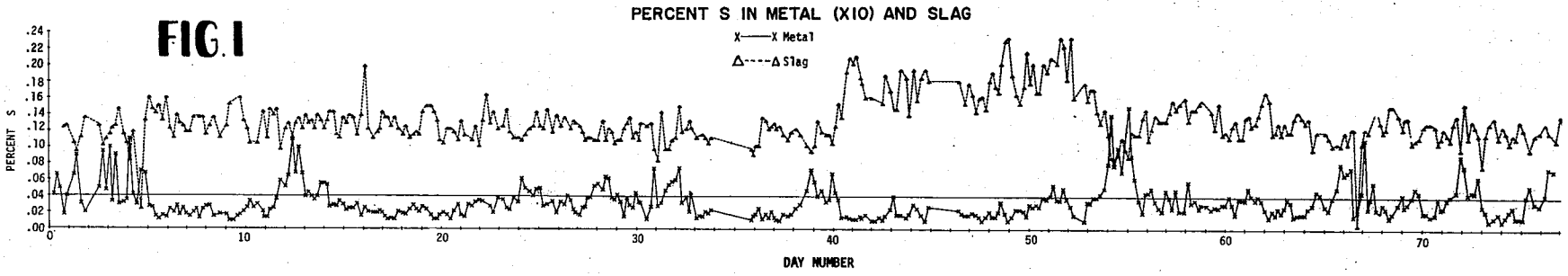
FIG. 1 is a computer plot of the sulfur content in both the metal and the slag removed from a steel mill blast furnace operated without the present invention.
Figure 2:
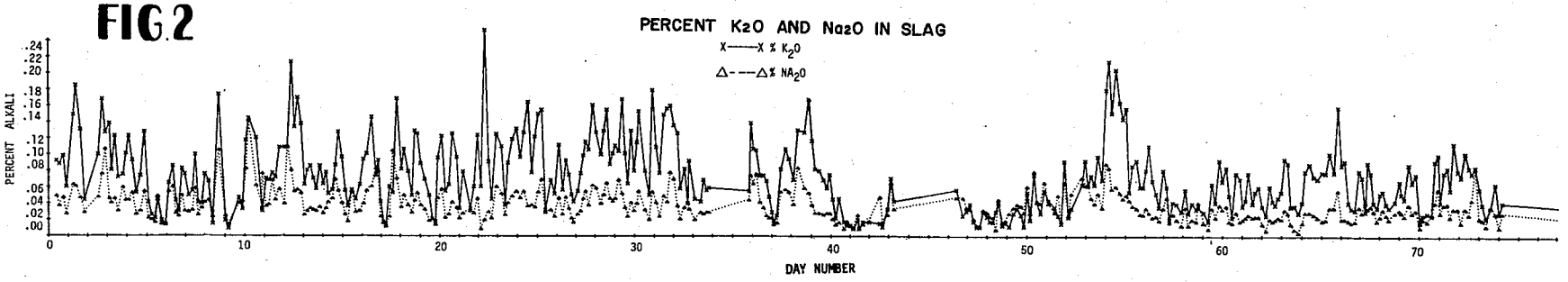
FIG. 2 is a computer plot of the percentages of $K_2O$ and $Na_2O$ in the slag removed from the same blast furnace.
Figure 3:
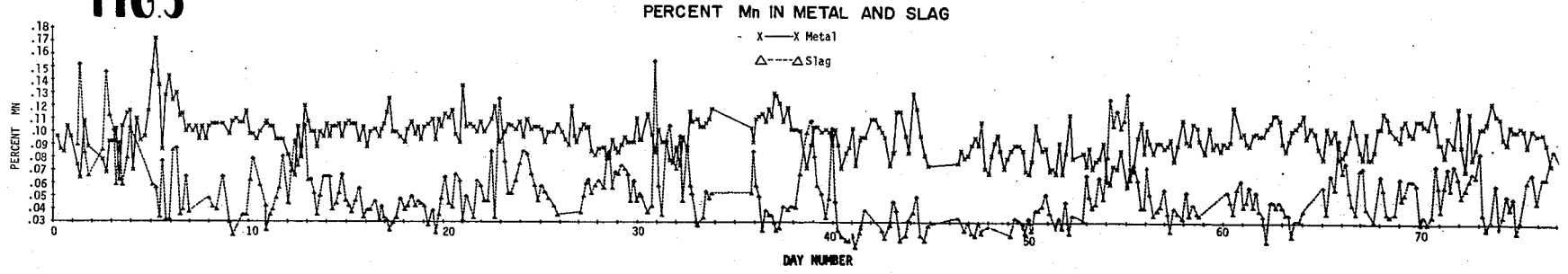
FIG. 3 is a computer plot of the percentages of manganese in both the metal and the slag removed from the same blast furnace.
Figure 4:
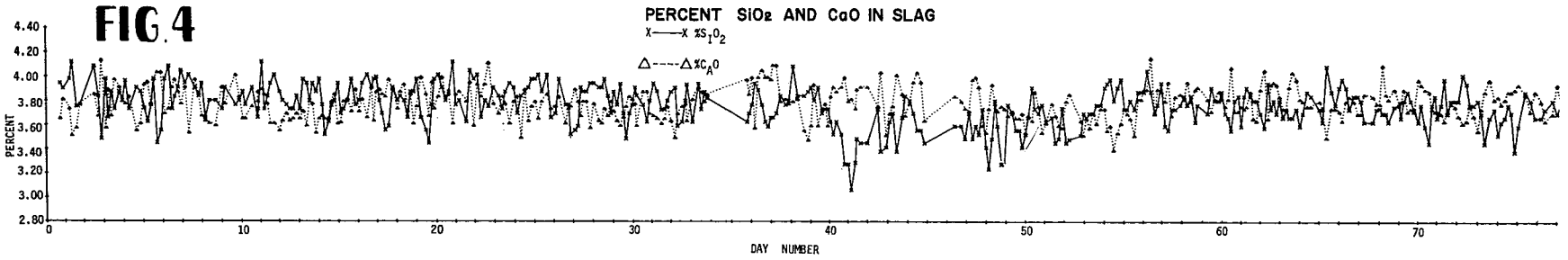
FIG. 4 is a computer plot of the percentages of $SiO_2$ and CaO in the slag removed from the same blast furnace.

While the invention will be described in connection with certain preferred embodiments, it will be understood that it is not intended to limit the invention to these particular embodiments. On the contrary, it is intended to cover all alternatives, modifications and equivalents as may be included within the spirit and scope of the invention as defined by the appended claims.

In accordance with the present invention, olivine is added to the blast furnace charge on a substantially continuous basis at an average rate of about 10 to about 100 pounds of olivine per ton of molten iron produced in the furnace to effect the continuous removal of the alkali metals from the furnace in the furnace slag and thereby stabilize the furnace operation. This olivine addition is particularly useful when the maximum alkali oxide content in the furnace slag fluctuates frequently by at least 100% above the average alkali oxide content in the slag, in the absence of the olivine addition. It has been found that the olivine addition causes the alkali metals to be removed from the furnace on a much more continuous basis, thereby avoiding alkali upsets in the furnace. Consequently, the furnace requires less fuel, and the percentage of on-specification metal produced by the furnace is greatly increased due to more constant levels of sulfur, manganese and silicon in the metal.

Olivine is a mineral with a typical analysis falling within the following general ranges:

| | |
|---|---|
| MgO | 42–49% by weight |
| $SiO_2$ | 41–44% |
| FeO | 6.5–7% |
| $Al_2O_3$, $K_2O$, $Na_2O$ | Trace |
| Loss on ignition | <2% |
| Real density | 3.2–3.5 g/cc. |

Although it is preferred to use substantially pure olivine in the process of this invention, the olivine may be fed to the blast furnace in the form of dunite, which is a rock containing olivine in commercial quantities. It will also be recognized that even substantially pure olivine as mined is mixed with a certain amount of alteration minerals and other undesirable materials which cannot be economically removed from the olivine, and these materials will normally be charged to the blast furnace along with the olivine in the process of this invention.

For use in the present invention, the olivine is preferably crushed and sized, and then added to the blast furnace along with the coke and iron ore. A suitable size for the crushed olivine is − 1 inch, + ⅜ inch (U.S. standard screen scale). The olivine is preferably charged to the furnace ahead of the coke and iron ore so that the olivine is distributed along the furnace walls. If desired, the olivine may be added to the furnace in the form of "fines," e.g., less than ⅜ inch, which are added to the conventional sinter formed in most steel mills for charging to the blast furnaces. Indeed, the addition of olivine in this manner has the advantage of distributing the olivine more uniformly throughout the furnace.

It is preferred to add the olivine to the furnace with every charge, but the olivine may be added to only selected charges at regular intervals, such as every other charge, if desired. The olivine may even be added at irregular intervals, such as whenever an accumulation of alkali metal within the furnace is detected; in this case, of course, the olivine would be added intermittently in larger amounts than would normally be added on a substantially continuous basis, e.g., greater than one ton per charge of olivine. For example, in the working examples to be described below, quartzite was charged intermittently in single charges consisting of 5 to 10 tons of quartzite in the base period prior to olivine charging. This would correspond to intermittent single charges of 12 to 24 tons of olivine on an equivalent silica charging basis.

The olivine is added to the blast furnace charge at a rate of 10 to 100 pounds of olivine per ton of metal produced. If it is desired to maintain a selected slag chemistry, or to avoid any increase in slag volume due to the olivine addition, adjustments may be made in the feed rates for the other slag-forming components of the charge materials. At charge rates below 10 pounds of olivine per ton of metal, the olivine does not have any significant effect on the alkali problem. At rates above 100 pounds of olivine per ton of metal, the MgO contributed by the olivine becomes too high to maintain the desired slag fluidity, even if substantial adjustments are made in the feed rates for the other slag-forming components.

Because the olivine does not contain any appreciable amounts of volatile components, heating the olivine to its fusion temperature in the blast furnace requires a minimum amount of energy. Also, the base/acid ratio of olivine closely approximates that of most blast furnace slags, so the olivine does not upset the normal metallurgical processes within the furnace, as sometimes occurs when quartzite or calcium chloride is charged to a blast furnace. Furthermore, since olivine has a substantially higher density than other iron-containing components of blast furnace charge materials, it occupies the least amount of furnace volume and hence leaves more room for the active components such as ore and coke. Although olivine has a relatively high melting point, in the presence of iron oxide the olivine reacts readily with lime and normal gangue components of coke and iron ore to produce the slag compositions that are generally desired in a blast furnace.

In this connection, it should be noted that olivine has been previously added to blast furnaces for the purpose of furnishing MgO at the level required in the furnace slag. Thus, Japanese patents 11412/71 and 3691/72 teach the use of olivine as a substitute for dolomite to increase the MgO content in the slag into the range of 6% to 14%, when the iron ore itself has a low MgO content. In the process of the present invention, however, the olivine is added to a furnace which produces a slag with an MgO content in the range of 6% to 18% before the olivine is added. (It is normally preferred to hold the MgO content in the 6% to 18% range after the olivine is added, although adjustments may be made in the feed rates for the other slag-forming components of the charge materials to maintain a selected target percentage for the MgO content of the slag and/or a selected base/acid ratio in the slag.) That is, the olivine is added to a blast furnace to which, according to the criteria of the Japanese patents, there would apparently be no reason to add olivine. And yet it has been discovered that the addition of olivine to such a furnace overcomes the problem of alkali upsets and stabilizes the furnace operation.

The present invention can be further understood from the following working examples and the accompanying drawings illustrating the results obtained in these examples. All indicated percentages are by weight.

EXAMPLE I

A commercial blast furnace which was experiencing severe upsets, believed to be associated with alkali build-ups, was operated both with and without the addition of olivine to the furnace charge. The furnace was initially tested without olivine for 14 weeks. During this base period, the blast furnace was operating according to normal and reverse charging procedures with intermittent additions of quartzite and calcium chloride as cleaning agents in conjunction with extra coke.

The olivine test started during the 15th week and extended through the 20th week. The addition of the standard cleaning agents was discontinued and only normal and reverse charging procedures were used in conjunction with the olivine test. The olivine was added to every other charge at a rate of 600 pounds per charge (1200 pounds of olivine added to every other charge) for the first 5 days. The charge to the blast furnace during this initial five days was as follows: 600 lbs. olivine, 59,000 lbs. ore, 11,800 lbs. sinter, 2,000 lbs.

dolomite, and 28,000 lbs. coke. This corresponds to a theoretical iron production of about 23 tons per charge. The olivine charge rate was increased to 800 pounds per charge for the next 7 days, 600 pounds per charge for the next 3 days, and 500 pounds per charge for the balance of the test period. During the olivine test period, hot metal production averaged 2,600 tons per day. Shown below is the composition of a typical average charge used while olivine was being charged at the 500 pound rate:

| | Pounds | $K_2O$ analysis (%) | $K_2O$ loading (lbs.) | $Na_2O$ analysis (%) | $Na_2O$ loading (lbs.) |
|---|---|---|---|---|---|
| Olivine | 500 | 0.04 | 0.2 | 0.1 | 0.5 |
| Ore | 72,000 | 0.03 | 21.6 | 0.03 | 21.6 |
| Sinter | 10,000 | 0.08 | 8.0 | 0.03 | 3.0 |
| Scrap | 2,000 | 0.10 | 2.0 | — | — |
| BOF Slag | 8,500 | 0.10 | 8.5 | 0.08 | 6.8 |
| Dolomite | 4,500 | 0.03 | 1.3 | 0.03 | 1.3 |
| Coke | 28,000 | 0.22 | 61.6 | 0.07 | 19.6 |
| | | | 103.02 | | 52.8 |

This charge rate corresponds to a theoretical iron production of 26 tons per charge and a total alkali loading of 6 pounds of alkali oxide per ton of hot metal produced.

During the test, the furnace slag was analyzed for S, $K_2O$, $Na_2O$, Mn, $SiO_2$, CaO, $Al_2O_3$, MgO and Fe, and the metal was analyzed for S, Mn and Si. These analyses were made on an average of about six times each day during the 20 weeks, and the results as plotted by a computer are illustrated in FIGS. 1 through 14. The statistical data presented in FIGS. 15 through 20 compare the 14 weeks of the base period with the last five weeks of the olivine test period. The 15th week of data was excluded from the statistical analysis because the olivine was not charged to the furnace until the second day of that week, and the furnace was believed to be in the process of purging the alkali salts so that steady-state operation of the furnace was not achieved until the 16th week.

On four occasions during the olivine test period, the addition of the olivine to the charge was interrupted for short periods as indicated in FIGS. 1–14. On one of these occasions, quartzite was added to the charge in place of the olivine, as also indicated in FIGS. 1–14. A comparison of FIGS. 1 and 8 with FIGS. 2 and 9 discloses that high sulfur contents in the metal usually coincided with major purges of alkali salts from the furnace. From FIGS. 3 and 10, it can be seen that the manganese content of the slag also increased in conjunction with the high alkali contents in the slag and high sulfur contents in the cast metal. Although these effects were significantly diminished during the period of olivine charging, they are still observable.

The major slag composition plots shown in FIGS. 4 and 11 and FIGS. 5 and 12 indicate that these quantities were relatively insensitive to changes in the charge compositions when olivine was not being charged to the furnace. The interruption of olivine and the simultaneous charging of quartzite together with the trend toward less basic sinter shows clearly in the slag $SiO_2$ and CaO plots for the 44th and 45th days in FIG. 11, indicating that the furnace was in a relatively clean condition as far as operational response was concerned.

Figure 5:
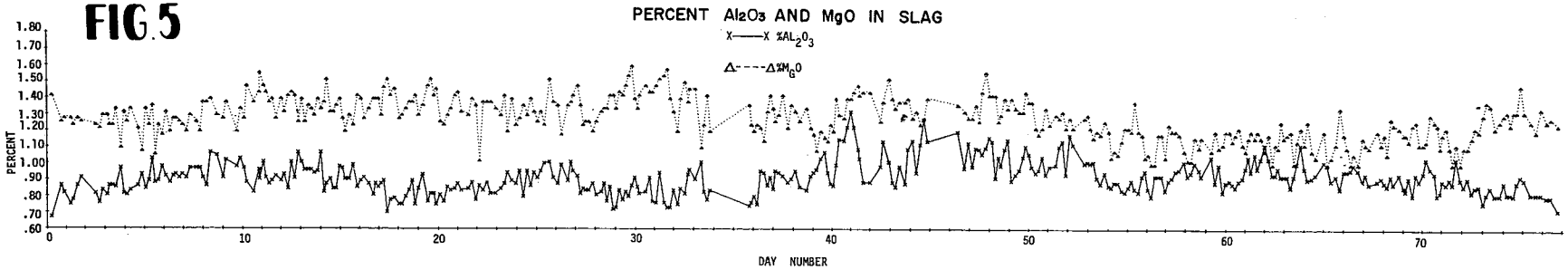
FIG. 5 is a computer plot of the percentages of $Al_2O_3$ and MgO in the slag removed from the same blast furnace.
Figure 12:
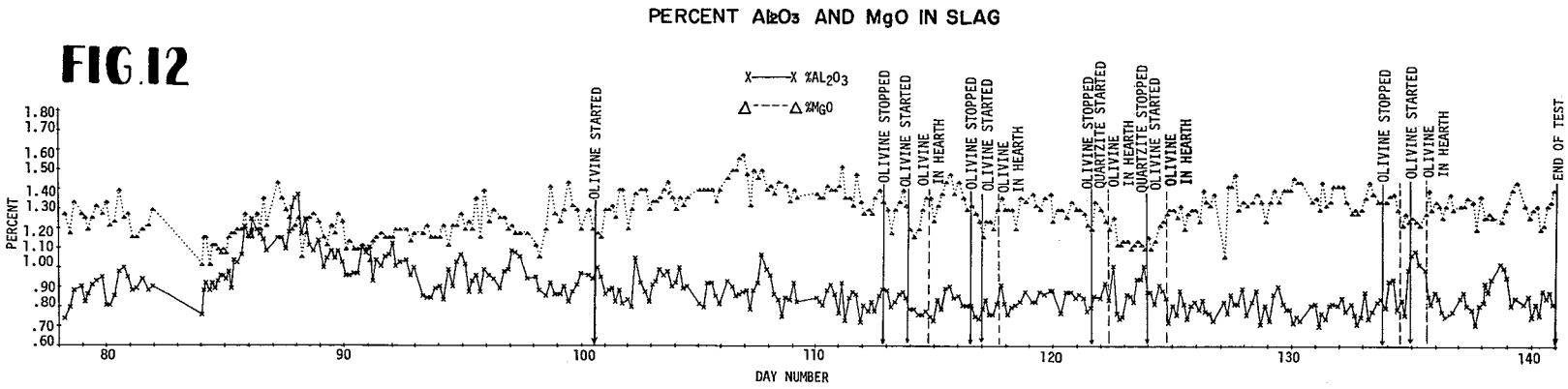
FIG. 12 is a computer plot of the percentages of $Al_2O_3$ and MgO in the slag removed from the same blast furnace operated both with and without the present invention.

On the other hand, the MgO content of the slag increased somewhat and the corresponding $Al_2O_3$ content diminished as olivine entered the hearth, as can be seen in FIGS. 5 and 12. The slag viscosity was observed to improve after olivine entered the hearth of the furnace, and it is believed that the increase in MgO and the decrease in $Al_2O_3$ may account for this observed improvement.

Figure 6:
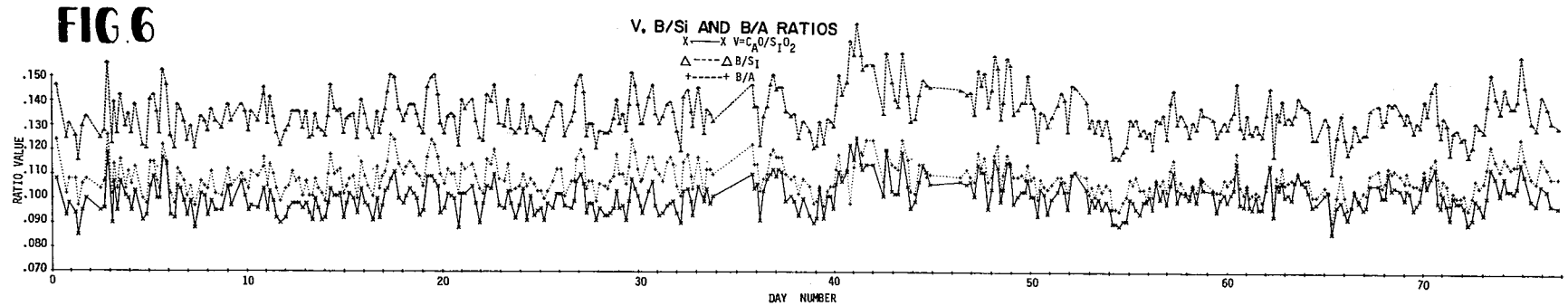
FIG. 6 is a computer plot of the $CaO/SiO_2$, base/Si and base/acid ratios in the slag removed from the same blast furnace.
Figure 13:
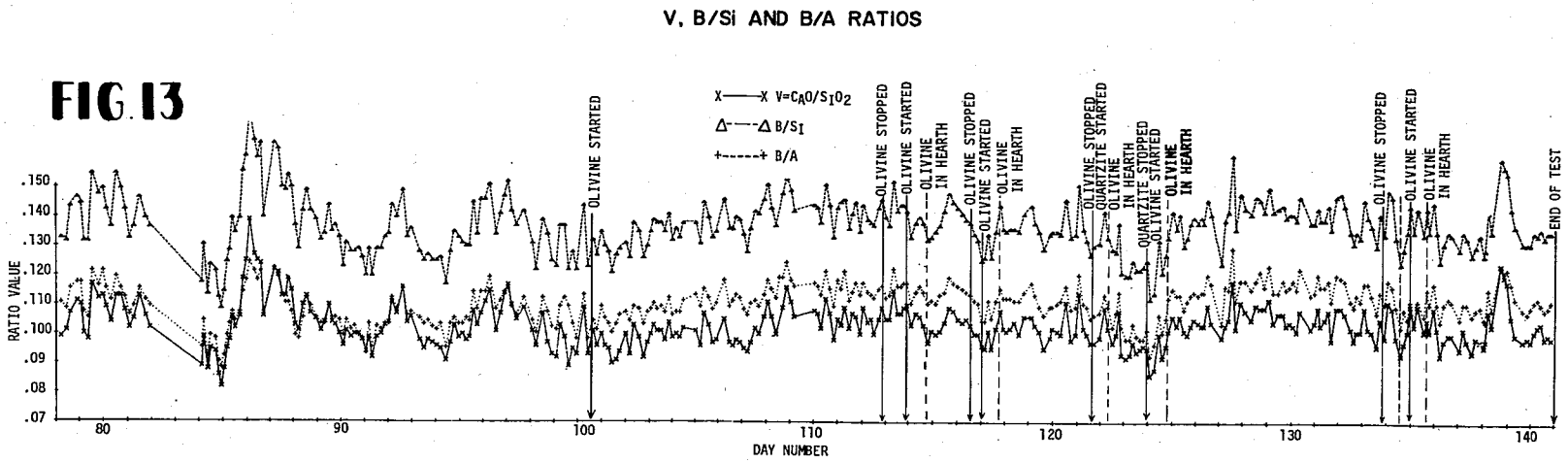
FIG. 13 is a computer plot of the $CaO/SiO_2$, base/Si and base/acid ratios in the slag removed from the same blast furnace operated both with and without the present invention.

FIGS. 6 and 13 shows plots of the following weight ratios:

$$\text{V Ratio} = CaO/SiO_2$$

$$\text{B/Si Ratio} = \frac{CaO + MgO}{SiO_2}$$

$$\text{Base/Acid Ratio} = \frac{CaO + MgO}{SiO_2 + Al_2O_3}$$

During the base period when olivine was not being added, it can be seen that these ratios fluctuated over rather broad ranges. During the olivine test period, the ratios were markedly reduced after the initial week. While the base/acid ratio at times approached 1.2 during the test, in a chemical sense this ratio may be misleading because of the low equivalent weight of MgO. Actually, the increase of MgO and the reduction of $Al_2O_3$ associated with the use of olivine may amount to a larger base/acid change than is normally indicated by the numerical change in the weight ratio. This could account for the improved desulfurizing characteristics of the slag since the higher basicities in a chemical sense would liberate more calcium for desulfurization purposes.

Figure 7:
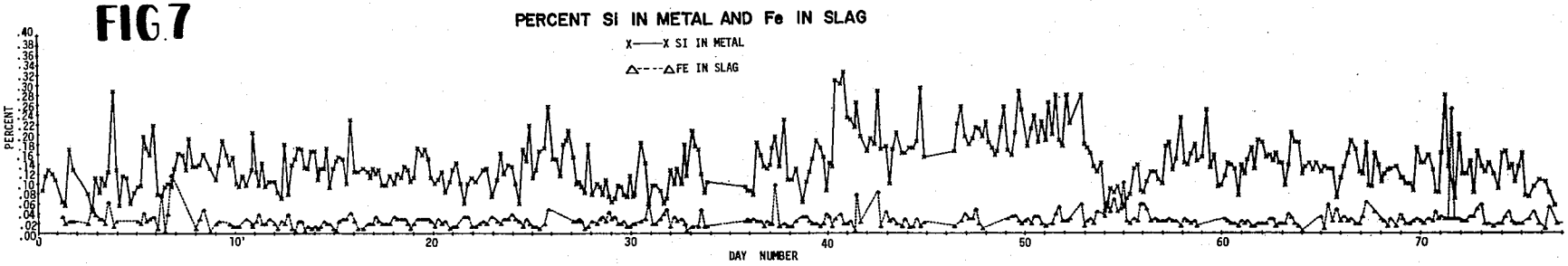
FIG. 7 is a computer plot of the percentages of silicon in the metal, and iron in the slag, removed from the same blast furnace.
Figure 8:
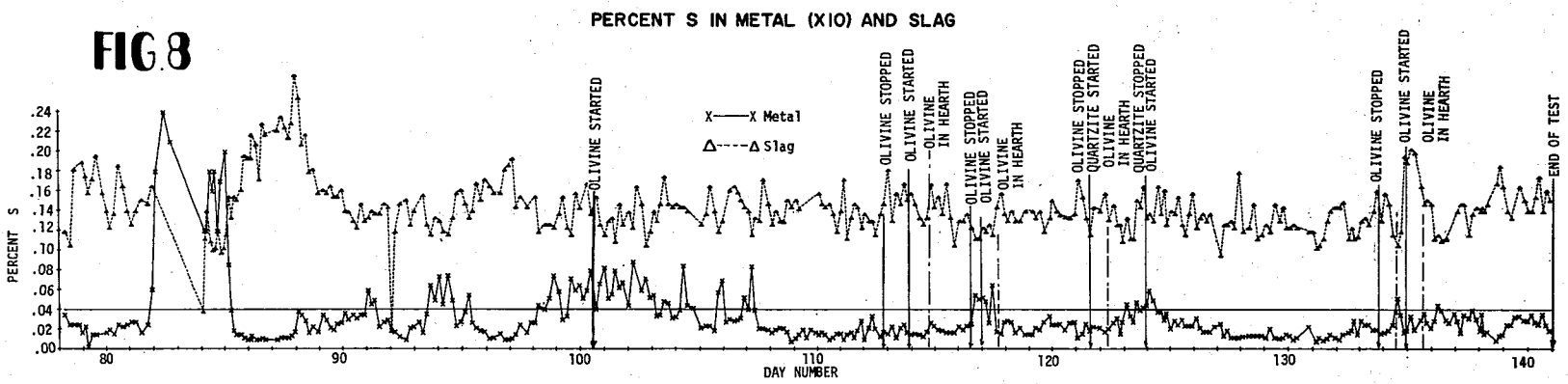
FIG. 8 is a computer plot of the sulfur content in both the metal and the slag removed from the same blast furnace operated both with and without the present invention.
Figure 9:
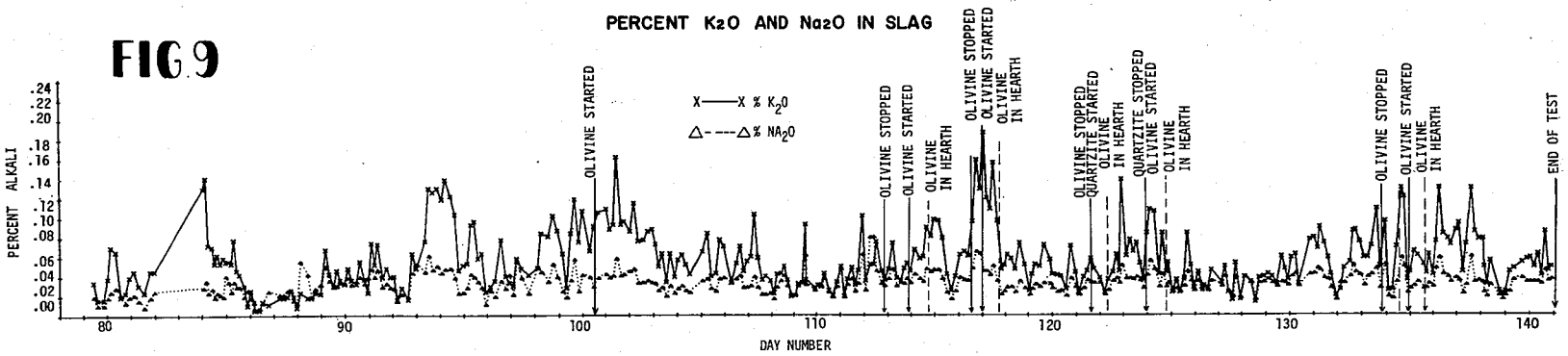
FIG. 9 is a computer plot of the percentages of $K_2O$ and $Na_2O$ in the slag removed from the same blast furnace operated both with and without the present invention.
Figure 10:
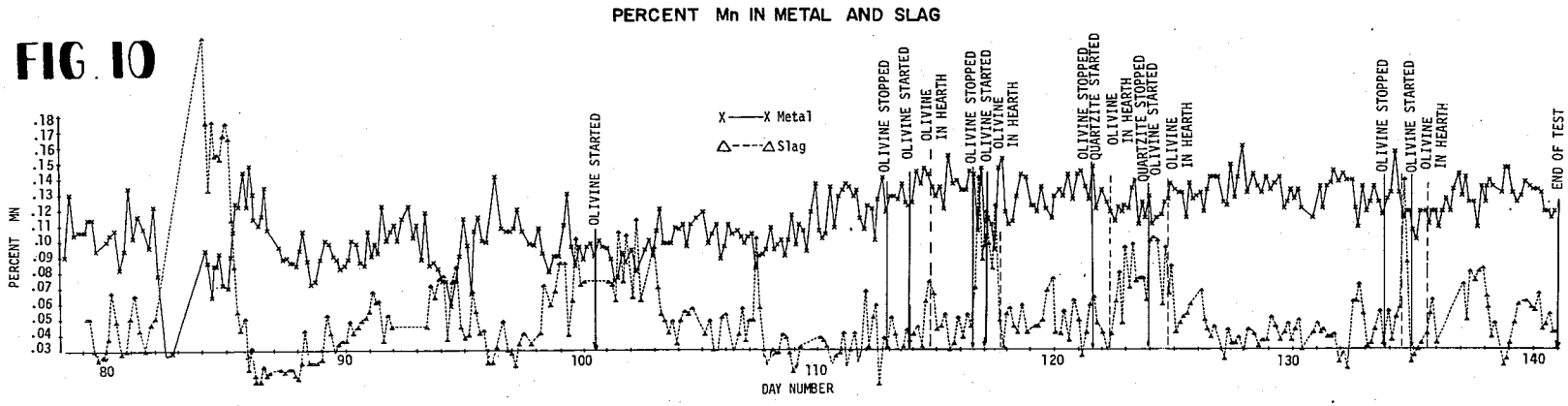
FIG. 10 is a computer plot of the percentages of manganese in both the metal and the slag removed from the same blast furnace operated both with and without the present invention.
Figure 11:
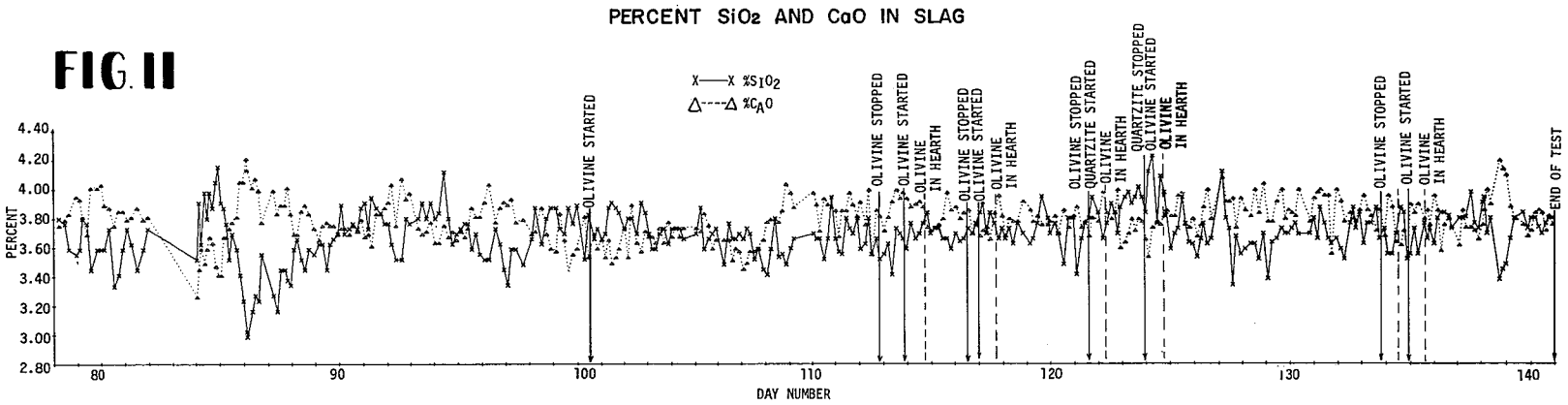
FIG. 11 is a computer plot of the percentages of $SiO_2$ and CaO in the slag removed from the same blast furnace operated both with and without the present invention.
Figure 14:
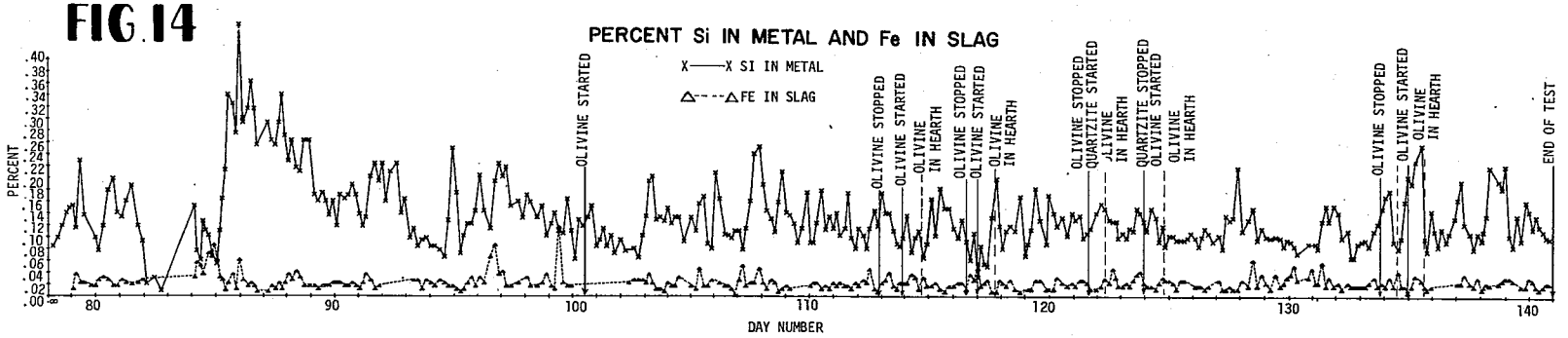
FIG. 14 is a computer plot of the percentages of silicon in the metal, and iron in the slag, removed from the same blast furnace operated both with and without the present invention.

FIGS. 7 and 14 compare the silicon content of the hot metal with the iron content of the slag. These plots are of particular interest because they show that better control of hot metal silicon content was achieved during the charging of olivine, which also indicates that fewer slips or peels were occurring while olivine was being added.

Once the blast furnace was brought under steady-state conditions following initiation of olivine charging, high quality, low sulfur iron was produced for two periods of 9 straight days and two periods of 5 straight days. At no time during the entire 14-week base period (when olivine was not being added) did the hot metal sulfur content stay below the target of 0.040% sulfur that length of time. The producution of high quality metal during the entire olivine test period of 5 weeks was broken on only three occasions, as indicated by the three upsets in the hot metal sulfur content indicated in FIG. 8. Each of these three upsets in the hot metal sulfur content coincided with the interruption of the olivine addition to the charge.

During the initial clean-out period which corresponds to the initial week of the olivine addition, the data shows that the furnace was purging a considerable amount of alkali. Such upsets should occur in conjunction with the initial use of an effective cleaner. The alkali purging was accompanied by low hot metal temperatures and high hot metal sulfur contents. Once steady-state conditions were achieved, however, the hot metal sulfur content remained below the 0.040% S target as long as olivine was being added, and occasional minor slips, peels, and irregular furnace movements occurred without harming hot metal quality.

On the four occasions when the olivine charge was interrupted, rather major changes in furnace operation were noted. A sizable slip and a minor coke mess occurred the first time the olivine charge was interrupted; although hot metal quality was not affected, slag fluidity notably decreased and furnace burden movement became more erratic. When the olivine charge was interrupted the second time, a major alkali purge occurred in conjunction with the production of off-quality metal. The upset was more severe this time because the furnace temperatures were low. During the third olivine interruption, quartzite was substituted for the olivine for a period of 2 days. As a result of the quartzite charging and some low basicity sinter which was also charged during this period, the base/acid ratio of the slag shifted appreciably toward lower values, and the hot metal sulfur content simultaneously increased.

The fourth interruption in the olivine charge again caused a major slip which corresponded with a high sulfur analysis in the metal.

It should be emphasized that minor slips and peels occurred occasionally throughout the course of the olivine test without affecting hot metal quality. The only time that major slips and peels occurred were after interruptions in the addition of olivine to the furnace charge. Between these periods of upsets caused by the olivine interruptions, on-specification metal containing less than 0.040% sulfur was produced for periods of 9, 5 and 9 consecutive days, respectively.

Observations made during the olivine test also indicated that the slag was more fluid and homogeneous than on other furnaces where olivine was not added, and moderate slag flows seemed to be the rule with no unusually large or small slag flows occurring. The subjective observations indicated that slag solutioning had improved.

Figure 15:
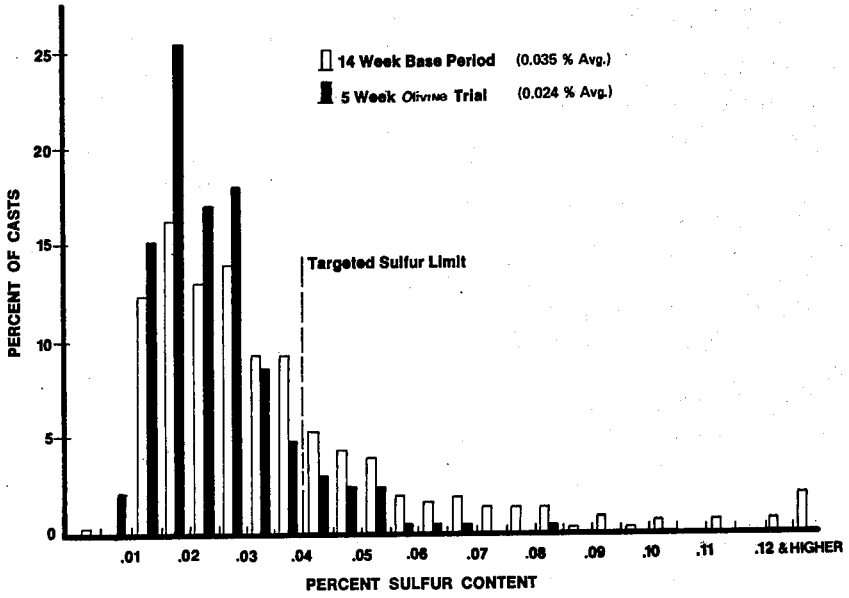
FIG. 15 is a bar graph illustrating the percentage of metal casts containing the respective sulfur contents.
Figure 16:
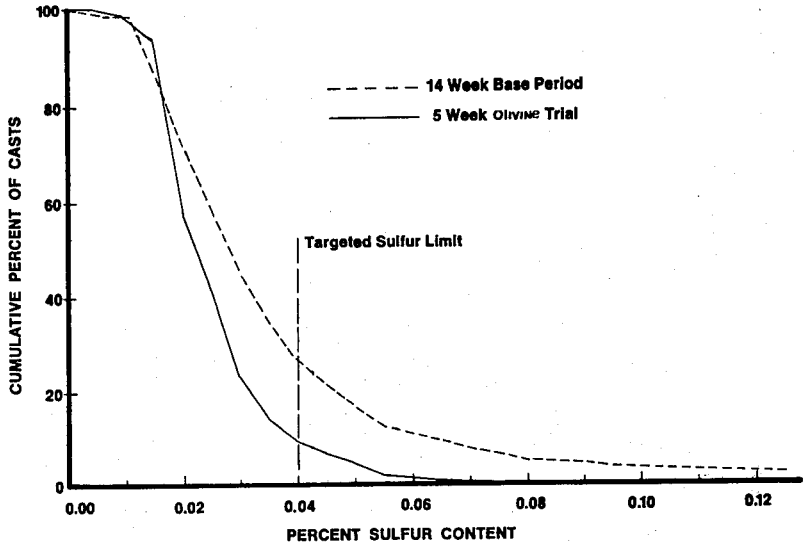
FIG. 16 is a bar graph illustrating the cumulative sulfur content in the metal casts.

In FIGS. 15 and 16, the sulfur and cumulative sulfur in the metal analyses are plotted as bar graphs to show the comparative distributions of the hot metal analyses. These two figures graphically show the improved sulfur quality of the hot metal while the olivine was being added to the blast furnace. For the 14-week base period, 27% of the casts exceeded the 0.04% sulfur target, while only 9% exceeded the target during the olivine test period. It should be noted that most of the off-specification casts during the olivine test period were produced when olivine was not present in the hearth.

Figure 17:
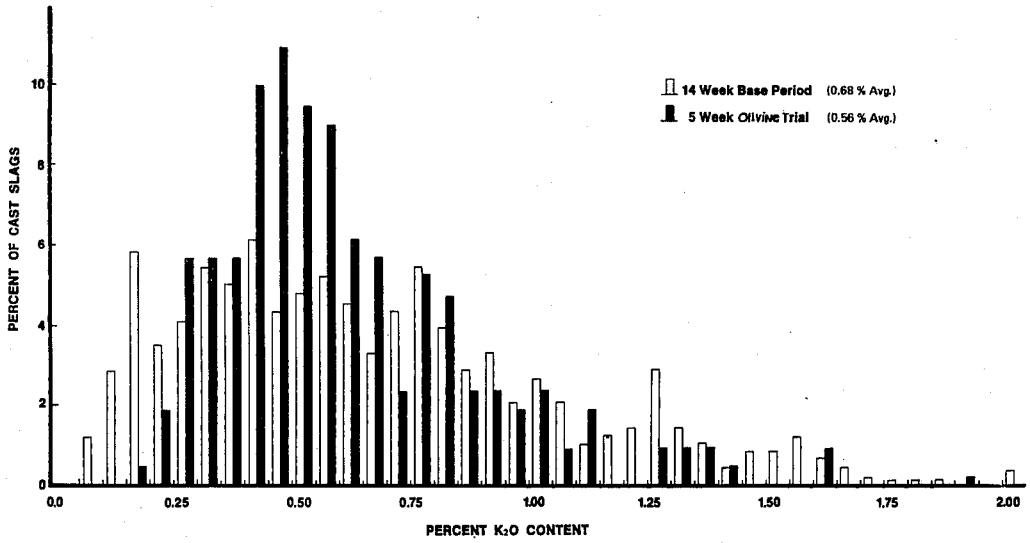
FIG. 17 is a bar graph illustrating the percentage of cast slags containing the respective potassium contents.
Figure 18:
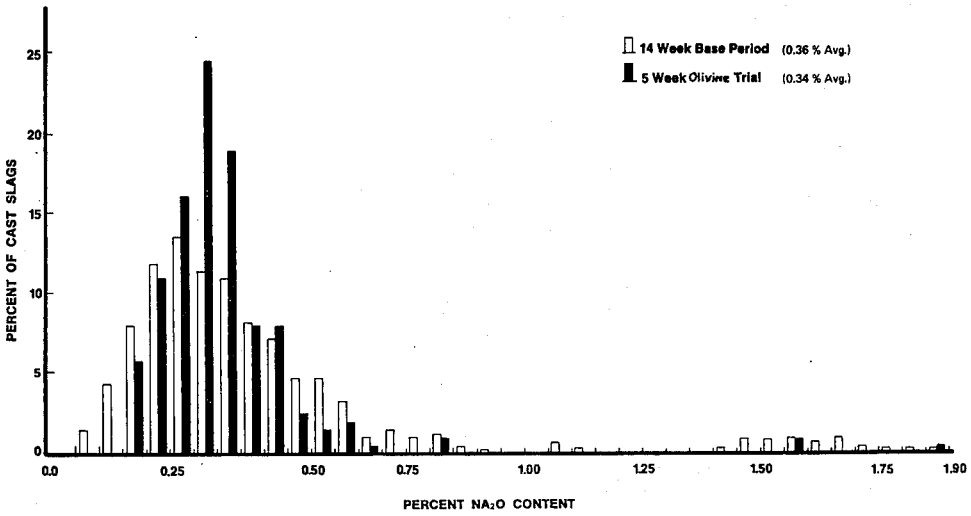
FIG. 18 is a bar graph illustrating the percentage of slag casts containing the respective sodium contents.

In FIGS. 17 and 18, the potassium and sodium in the cast slags are plotted as bar graphs to show the comparative distributions of the slag analyses. These figures clearly show the narrowed distributions of potassium and sodium in the slags during the olivine test period. The low sides of the distributions show a diminished tendency to accumulate alkali in the furnace over the olivine test period. Similarly, the high alkali content portions of the distributions shown a greatly diminished tendency for high alkali purges to occur during the olivine test period. This indicates that slips and peels during the olivine test period were substantially less severe than those occurring during the base period.

Figure 19:
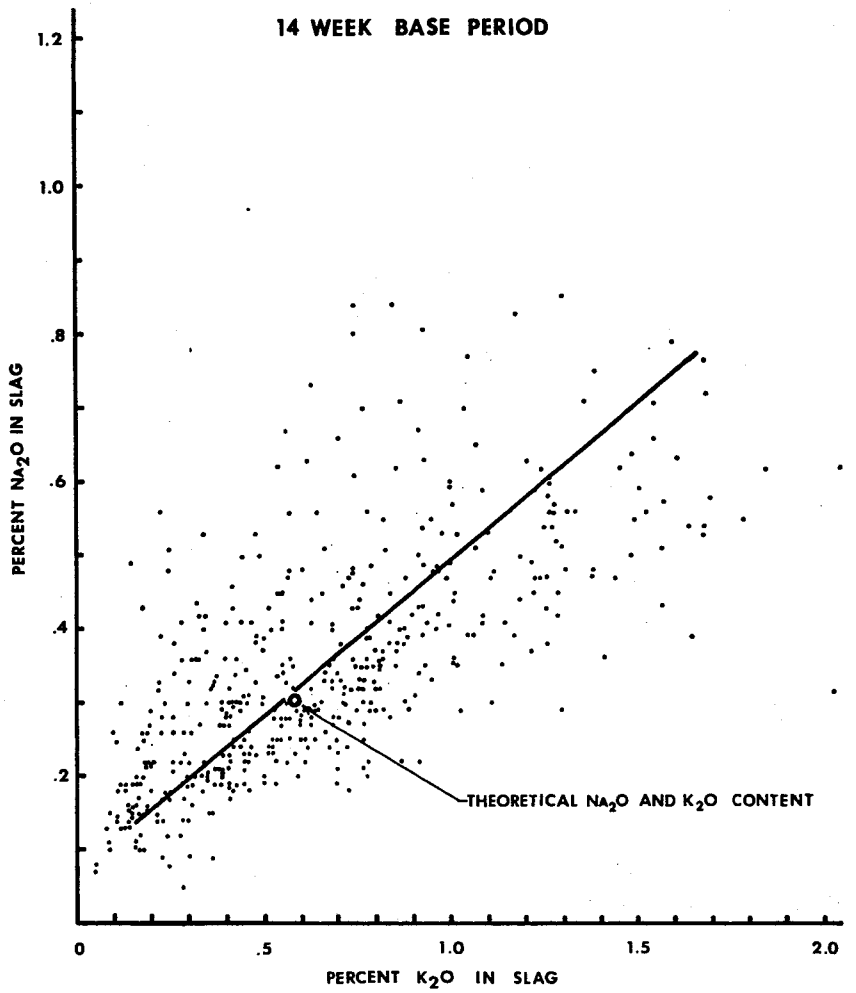
FIG. 19 is a plot of the percentages of sodium and potassium in the cast slags while the furnaces was operated without the present invention.
Figure 20:
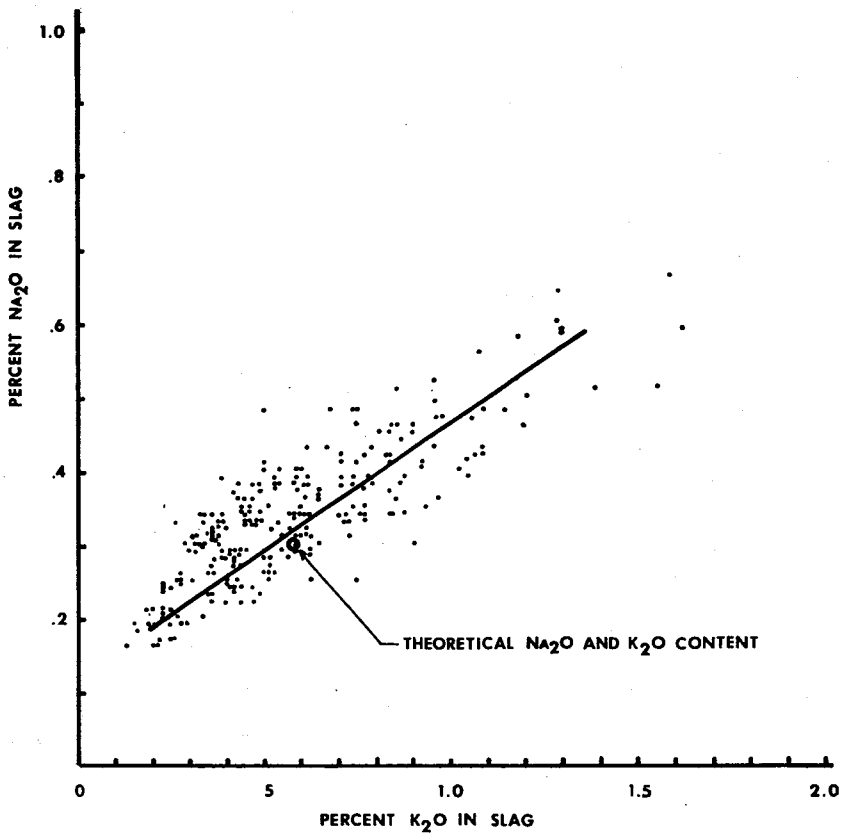
FIG. 20 is a plot of the percentages of sodium and potassium contained in the cast slags while the furnace was operated with the present invention.

FIGS. 19 and 20 show the sodium and potassium contents in the slag plotted against each other during the base period and the olivine test period, respectively. The theoretical sodium-potassium points shown in the plots are derived from the compositions of the charge materials and the charge schedule. It can be seen that the data distribution for the base period is erratic and difficult to correlate, while the data distribution for the olivine test period gives a fairly good linear approximation. Accumulation of alkalis is indicated below and to the left of the theoretical points, while purging is indicated above or to the right of these theoretical points. Since potassium compounds tend to be more volatile than the corresponding sodium compounds, potassium should accumulate preferentially in a blast furnace. Sodium on the other hand is believed to accumulate by combining chemically with coke. Thus, only under relative steady-state conditions would the ratio of potassium and sodium remain approximately constant.

EXAMPLE II

Another commercial blast furnace that was experiencing severe upsets, believed to be associated with alkali build-ups, was operated with the addition of olivine to the furnace charge. The average charge to the furnace over the 19-day olivine test period consisted of:

| | Pounds | $K_2O$ analysis (%) | $K_2O$ loading (lbs.) | $Na_2O$ analysis (%) | $Na_2O$ loading (lbs.) |
|---|---|---|---|---|---|
| Olivine | 400 | 0.04 | 0.2 | 0.10 | 0.4 |
| Ore No. 1 | 30,050 | 0.05 | 15.0 | 0.02 | 6.0 |
| Ore No. 2 | 450 | 1.3 | 6.0 | 0.09 | 4.0 |
| Sinter | 2,000 | 0.17 | 3.4 | 0.09 | 2.0 |
| Scrap | 1,000 | 0.10 | 1.0 | — | — |
| Calcite | 2,700 | 0.05 | 1.4 | 0.01 | 0.3 |
| Dolomite | 2,100 | 0.10 | 0.2 | 0.01 | 0.2 |
| Coke | 14,250 | 0.17 | 24.2 | 0.06 | 8.5 |
| | | | 51.4 | | 21.4 |

The theoretical production of hot metal from the above charge is 11.7 tons per charge at a total alkali loading of 6.2 pounds of alkali oxides per ton of hot metal produced.

Olivine was charged in double amounts on every other charge because smaller quantities could not be measured. This corresponded to an olivine charging rate of 2% olivine per ton of hot metal produced. Hot metal production during the olivine test period averaged 1,000 tons per day.

Cyanide levels in the scrubber water were measured during the test period, and it was noted that these cyanide levels fluctuated widely, exhibiting more than a tenfold variation. Furthermore, the maximum points in these cyanide variations tended to coincide with slips and/or major alkali purges by way of the slag. A good example of this was a large slip that occurred during the initial cleaning-out period encountered with the initiation of olivine charging. As shown in the data presented in the table below, cyanide levels in the scrubber water increased dramatically from a low of 0.47 ppm. to a peak of 16.8 ppm. during this upset. The table compares the cyanide content of the scrubber water with the $K_2O$ content of the cast slag over a 2½ day period:

| Scrubber Water Cyanide Content (ppm) | Cast Slag $K_2O$ Analysis (%$K_2O$) |
|---|---|
| 0.47 | 0.37 |
| 0.20 | 0.18 |
| 3.12 | 0.38 |
| 9.37 | 0.64 |
| 16.80 | 0.80 |
| 14.33 | 0.63 |
| 5.50 | 1.04 |
| 4.49 | — |
| 1.58 | 1.43 |
| 0.74 | 1.17 |
| 0.54 | 1.59 |
| 0.44 | 1.51 |
| 0.44 | 0.92 |

As can be seen from the above data, the $K_2O$ analyses of the cast slag started to increase about the same time that the cyanide content of the scrubber water started to increase, although the peak loading of cyanides in the waste water occurred much sooner than the peak loading of alkalis in the slag. Although the test did not last long enough to determine whether the olivine could be used to smooth out the wide fluctuations in the cyanide content of the scrubber water, the results described in Example I show that the addition of olivine to the furnace charge smooths out slips and alkali purges. Consequently, it appears that the olivine addition would also eventually smooth out wide fluctuations in the cyanide levels in the scrubber water, thereby facilitating the consistent removal or conversion of such cyanides in the scrubber effluent before it is discharged to the environment.

I claim as my invention:

1. In a process of preparing molten iron in a blast furnace in which the alkali loading to the furnace is at least about 4 pounds of alkali oxides per ton of metal produced, the alkai metal content in the furnace slag fluctuates widely due to repetitive accumulation and purging of alkali metals in the furnace over extended operating periods with corresponding fluctuations in the sulfur content and temperature of the molten metal, and the MgO content in the furnace slag is in the range of from about 6% to about 18% by weight, the improvement comprising adding olivine to the furnace charge on a substantially continuous basis at an average rate of about 10 to about 100 pounds of olivine per ton of molten iron produced in the furnace to effect the continuous removal of the alkali metals from the furnace in the furnace slag and thereby stabilize the furnace operation.

2. The process of claim 1 wherein the maximum alkali oxide content in the furnace slag fluctuates frequently by at least about 100% above the average alkali metal content in the slag, in the absence of the olivine addition.

3. The process of claim 1 wherein the olivine is charged to the furnace ahead of the iron ore portion of the charge.

4. In a process of preparing molten iron in a blast furnace in which the alkali loading to the furnace is at least about 4 pounds of alkali oxides per ton of metal produced, the MgO content in the furnace slag is in the range of from about 6% to about 18% by weight, and the cyanide content in the scrubber water fluctuates widely due to repetitive accumulation and purging of alkali metals in the furnace over extended operating periods, the improvement comprising adding olivine to the furnace charge on a substantially continuous basis at an average rate of about 10 to about 100 pounds of olivine per ton of molten metal produced in the furnace to effect the continuous removal of the alkali metals from the furnace in the furnace slag and thereby stabilize the furnace operation.

5. The process of claim 4 wherein the maximum alkali oxide content in the furnace slag fluctuates frequently by at least about 100% above the average alkali metal content in the slag, in the absence of the olivine addition.

6. The process of claim 4 wherein the olivine is charged to the furnace ahead of the iron ore portion of the charge.

7. In a process of preparing molten iron in a blast furnace in which the alkali loading to the furnace is at least about 4 pounds of alkali oxides per ton of metal produced, the alkali metal content in the furnace slag fluctuates widely due to repetitive accumulation and purging of alkali metals in the furnace over extended operating periods with corresponding fluctuations in the sulfur content and temperature of the molten metal, and the MgO content in the furnace slag is in the range of from about 6% to about 18% by weight, the improvement comprising intermittently charging olivine to the furnace whenever the alkali metals accumulate to an excessive level in the furnace to effect the removal of the alkali metals from the furnace in the furnace slag and thereby stabilize the furnace operation.

8. The process of claim 7 wherein the amount of olivine intermittently charged to the furnace is at least 1 ton in a single charge.

* * * * *